US008853938B2

(12) United States Patent
Cho et al.

(10) Patent No.: US 8,853,938 B2
(45) Date of Patent: Oct. 7, 2014

(54) INORGANIC ELECTROLUMINESCENT DEVICE COMPRISING AN INSULATING LAYER, METHOD FOR FABRICATING THE ELECTROLUMINESCENT DEVICE AND ELECTRONIC DEVICE COMPRISING THE ELECTROLUMINESCENT DEVICE

(75) Inventors: Kyung Sang Cho, Yongin-si (KR); Byoung Lyong Choi, Yongin-si (KR); Jae Ho You, Yongin-si (KR); Eun Kyung Lee, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 1314 days.

(21) Appl. No.: 11/753,129

(22) Filed: May 24, 2007

(65) Prior Publication Data

US 2008/0150425 A1 Jun. 26, 2008

(30) Foreign Application Priority Data

Dec. 20, 2006 (KR) ..... 10-2006-0130983

(51) Int. Cl.
*H05B 33/02* (2006.01)
*H05B 33/22* (2006.01)

(52) U.S. Cl.
CPC ..... *H05B 33/22* (2013.01)
USPC ..... 313/509; 313/506; 445/24

(58) Field of Classification Search
USPC ..... 313/498–512; 315/169.1, 169.3; 428/690–691, 917; 438/26–29, 34, 82; 257/40, 72, 98–100, 642–643, 759; 427/58, 64, 66, 532–535, 539; 445/24–25
See application file for complete search history.

(56) References Cited

U.S. PATENT DOCUMENTS

| | | | | |
|---|---|---|---|---|
| 6,111,274 | A * | 8/2000 | Arai | 257/96 |
| 2004/0135495 | A1 | 7/2004 | Wu et al. | |
| 2005/0012455 | A1* | 1/2005 | Lee et al. | 313/506 |
| 2005/0082540 | A1* | 4/2005 | Nishikawa | 257/72 |
| 2007/0085476 | A1* | 4/2007 | Hirakata et al. | 313/506 |
| 2007/0179318 | A1* | 8/2007 | Kawamura et al. | 564/434 |

FOREIGN PATENT DOCUMENTS

| | | |
|---|---|---|
| KR | 1020000027755 | 5/2000 |
| KR | 1020020043161 | 6/2002 |

* cited by examiner

*Primary Examiner* — Donald Raleigh
(74) *Attorney, Agent, or Firm* — Cantor Colburn LLP

(57) ABSTRACT

Disclosed is an inorganic electroluminescent device. The inorganic electroluminescent device comprises a hole transport layer, a light-emitting layer, an inorganic electron transport layer and an electron injecting electrode sequentially formed on a hole injecting electrode wherein an insulating layer is formed between the electron injecting electrode and the inorganic electron transport layer.

Further disclosed are a method for fabricating the electroluminescent device and an electronic device comprising the electroluminescent device.

The inorganic electroluminescent device achieves uniform light emission from the entire light-emitting surface of the device, resulting in an improvement in the reliability and stability of the device. The inorganic electroluminescent device is suitable for use in the manufacture of electronic devices, including display devices, illuminators and backlight units.

28 Claims, 3 Drawing Sheets

INORGANIC ELECTROLUMINESCENT DEVICE COMPRISING AN INSULATING LAYER, METHOD FOR FABRICATING THE ELECTROLUMINESCENT DEVICE AND ELECTRONIC DEVICE COMPRISING THE ELECTROLUMINESCENT DEVICE

This non-provisional application claims priority to Korean Patent Application No. 2006-130983 filed on Dec. 20, 2006, and all the benefits accruing therefrom under 35 U.S.C. §119 (a), which is herein incorporated by reference in its entirety.

BACKGROUND OF THE INVENTION

1. Field of the Invention

The present invention relates to an inorganic electroluminescent device comprising an insulating layer, a method for fabricating the electroluminescent device, and an electronic device comprising the electroluminescent device. More particularly, the present invention relates to an inorganic electroluminescent device comprising a hole transport layer, a light-emitting layer, an inorganic electron transport layer and an electron injecting electrode sequentially formed on a hole injecting electrode wherein an insulating layer is formed between the electron injecting electrode and the inorganic electron transport layer, a method for fabricating the electroluminescent device, and an electronic device comprising the electroluminescent device.

2. Description of the Related Art

Electroluminescent devices refer collectively to devices that use a luminescent material to emit light when an electric field is applied to the luminescent material. Electroluminescent devices are classified into organic electroluminescent devices and inorganic electroluminescent devices depending on whether an organic material or an inorganic material is used to form a fluorescent layer.

Inorganic electroluminescent devices are devices that utilize collision of electrons that have been accelerated by a high electric field to emit light, and are subdivided into alternating-current thin-film electroluminescent devices, direct-current thick-film electroluminescent device, and the like, with regard to the thickness of the films and the operating modes of the electroluminescent devices prepared with them.

In recent years, quantum dot (also referred to herein as "nanodot") inorganic electroluminescent devices comprising a light-emitting layer formed using quantum dots-have been used to prepare current-driven (that is, direct current-driven) thin-film electroluminescent devices. However, current-driven inorganic electroluminescent devices comprising an electron transport layer ("ETL") made of an inorganic material can often exhibit, when electrons are injected from an electron injecting electrode into the electron transport layer, only a partial light emission limited to the edges of the electron injecting electrode, and therefore uniform light emission from the entire light-emitting surface is not achieved.

To solve these problems, attempts have been made to increase the voltage applied to devices to achieve more efficient injection of electrons. As a result of these attempts however, undesirable phenomena such as bubbling, occur between the electron injecting electrode and an adjacent electron transport layer, causing separation of the electron injecting electrode.

U.S. Patent Publication No. 2004-0135495 discloses color electroluminescent displays comprising a light-emitting layer, an electrode layer and an insulating layer formed therebetween. Further, Korean Patent Laid-open Nos. 2002-43161 and 2000-27755 disclose an inorganic thin film electroluminescent device comprising an energy barrier layer and a current control layer formed under an electrode, and an organic electroluminescent device comprising a cathode with a bilayer structure, respectively.

However, the prior art devices fail to solve the aforementioned problems. Accordingly, there is still an urgent need to develop an inorganic electroluminescent device that achieves efficient light emission from the entire light-emitting surface of the device.

BRIEF SUMMARY OF THE INVENTION

In view of the problems of the prior art, in and embodiment, an inorganic electroluminescent device comprises an electron injecting electrode, an inorganic electron transport layer and a thin insulating layer formed therebetween such that strong fringe field effects, which occur at the edges of the electron injecting electrode, are eliminated and light is uniformly emitted from the entire light-emitting surface, thereby achieving efficient light emission from the entire light-emitting surface of the device.

In another embodiment, a method is provided for fabricating an inorganic electroluminescent device comprising an insulating layer by which various deposition processes and insulating materials can be employed to form the insulating layer.

In another embodiment, an electronic device comprises the inorganic electroluminescent device.

In an embodiment, an inorganic electroluminescent device comprises a hole transport layer, a light-emitting layer, an inorganic electron transport layer and an electron injecting electrode sequentially formed on a hole injecting electrode wherein an insulating layer is formed between the electron injecting electrode and the inorganic electron transport layer.

In another embodiment, a method is provided for fabricating an inorganic electroluminescent device comprising a hole transport layer, a light-emitting layer, an inorganic electron transport layer and an electron injecting electrode sequentially formed on a hole injecting electrode wherein an insulating layer is formed between the electron injecting electrode and the inorganic electron transport layer, the method comprising the step of depositing an inorganic or organic insulating material on the inorganic electron transport layer to form the insulating layer between the electron injecting electrode and the inorganic electron transport layer.

In another embodiment, an electronic device comprises the inorganic electroluminescent device.

BRIEF DESCRIPTION OF THE DRAWINGS

The above and other features and other advantages will be more clearly understood from the following detailed description taken in conjunction with the accompanying drawings, in which.

DETAILED DESCRIPTION OF THE INVENTION

Figure 1:
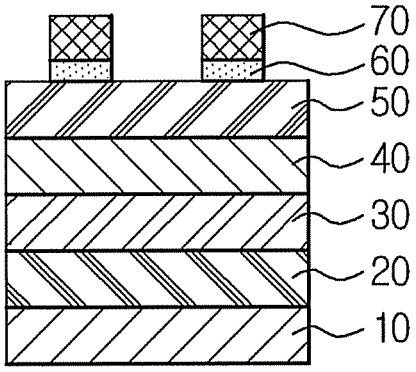
FIG. 1 is a schematic cross-sectional view of an exemplary inorganic electroluminescent device according to one embodiment.

The present invention will now be described in greater detail with reference to the accompanying drawings.

It will be understood that when an element is referred to as being "on" another element, it can be directly on the other element or intervening elements may be present therebetween. In contrast, when an element is referred to as being "disposed on" or "formed on" another element, the elements are understood to be in at least partial contact with each other, unless otherwise specified.

The terminology used herein is for the purpose of describing particular embodiments only and is not intended to be limiting of the invention. As used herein, the singular forms "a", "an" and "the" are intended to include the plural forms as well, unless the context clearly indicates otherwise. The use of the terms "first", "second", and the like do not imply any particular order but are included to identify individual elements. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, like reference numerals in the drawings denote like elements and the thicknesses of layers and regions are exaggerated for clarity.

An inorganic electroluminescent device as disclosed herein comprises a hole transport layer, a light-emitting layer, an inorganic electron transport layer and an electron injecting electrode sequentially formed on a hole injecting electrode wherein an insulating layer is formed between the electron injecting electrode and the inorganic electron transport layer.

The inorganic electroluminescent device can have a structure in which a substrate, a hole injecting electrode, a hole transport layer, a light-emitting layer, an inorganic electron transport layer, an insulating layer and an electron injecting electrode sequentially stacked in this order from the bottom (i.e., substrate-side) of the device, but is not limited to this structure.

The insulating layer of the inorganic electroluminescent device is formed of an inorganic or organic insulating material.

Any insulating material may be used to form the insulating layer. In an exemplary embodiment, the inorganic insulating material is selected from the group consisting of, but not limited to, LiF, $BaF_2$, $TiO_2$, ZnO, $SiO_2$, SiC, $SnO_2$, $WO_3$, $ZrO_2$, $HfO_2$, $Ta_2O_5$, $BaTiO_3$, $BaZrO_3$, $Al_2O_3$, $Y_2O_3$, $ZrSiO_4$, $Si_3N_4$, and TiN.

The organic insulating material is selected from the group consisting of, but not limited to, polymers including epoxy resins and phenolic resins; phenyl-substituted triazoles including 3-(4-biphenylyl)-4-phenyl-5-tert-butylphenyl-1,2,4-triazole ("TAZ") 3,4,5-triphenyl-1,2,4-triazole, and 3,5-bis(4-tert-butylphenyl)-4-phenyl-1,2,4-triazole; and fatty acid monomers including arachidic acid and stearic acid.

In an embodiment, the insulating layer has a thickness of 0.5 nm to 2 nm, and more specifically from 1.0 nm to 1.5 nm. When the thickness of the insulating layer is greater than 2 nm, the total thickness of the layers into which electrons are injected is increased, causing no flow of current or a marked increase in resistance. When the insulating layer is in the form of a thin film having a thickness as defined above, tunneling of electrons occurs, resulting in a reduction in the total thickness of the layers into which electrons are injected.

The substrate of the electroluminescent device may be a substrate used in typical inorganic electroluminescent devices. In an embodiment, a glass or transparent plastic substrate is used for high transparency, surface smoothness, ease of handling, and excellent waterproofness. Exemplary substrates include glass, polyethylene terephthalate, and polycarbonate substrates. The thickness of the substrate is in an embodiment from 0.3 mm to 1.1 mm, but is not limited to this range.

The hole injecting electrode formed on a surface of the substrate can be formed of an electrically conductive metal or its oxide so that holes can be easily injected. Exemplary materials for the hole injecting electrode include, without limitation, indium tin oxide ("ITO"), indium zinc oxide ("IZO"), nickel (Ni), platinum (Pt), gold (Au), silver (Ag), iridium (Ir), and oxides of these metal elements.

Materials for the hole transport layer of the inorganic electroluminescent device are not especially limited so long as they are capable of transporting holes, where examples thereof include poly(3,4-ethylenedioxythiophene ("PEDOT")/polystyrene parasulfonate ("PSS"), poly-N-vinylcarbazole, polyphenylenevinylene, polyparaphenylene, polymethacrylate, poly(9,9-octylfluorene), poly(spiro-fluorene), N,N'-diphenyl-N,N'-bis(3-methylphenyl)-1,1'-biphenyl-4,4'-diamine ("TPD"), N,N'-di(naphthalen-1-yl)-N—N'-diphenyl-benzidine, tris(3-methylphenylphenylamino)-triphenylamine ("m-MTDATA"), poly(9,9'-dioctylfluorene-co-N-(4-butylphenyl)diphenylamine) ("TFB"), copper phthalocyanine, polyvinylcarbazole ("PVK"), and derivatives thereof; starburst dendrimers; metal oxides, such as, for example, $TiO_2$, ZnO, $SiO_2$, $SnO_2$, $WO_3$, $ZrO_2$, $HfO_2$, $Ta_2O_5$, $BaTiO_3$, $BaZrO_3$, $Al_2O_3$, $Y_2O_3$, and $ZrSiO_4$; and semiconductors having a band gap of 2.4 eV or higher, such as, for example, CdS, ZnSe, and ZnS. The thickness of the hole transport layer can be from 10 nm to 100 nm, but is not limited to this range.

Materials that are suitable for the light-emitting layer of the inorganic electroluminescent device according to the present invention include, but are not limited to, Group II-VI compound semiconductor nanocrystals, Group III-V compound semiconductor nanocrystals, Group IV-VI compound semiconductor nanocrystals, Group IV compound semiconductor nanocrystals, and mixtures thereof.

The Group II-VI compound semiconductor nanocrystals can be, in an exemplary embodiment, semiconductor nanocrystals of a binary compound, such as CdSe, CdTe, ZnS, ZnSe, or ZnTe; semiconductor nanocrystals of a ternary compound, such as CdSeS, CdSeTe, CdSTe, ZnSeS, ZnSeTe, ZnSTe, CdZnS, CdZnSe, or CdZnTe; or semiconductor nanocrystals of a quaternary compound, such as CdZnSeS, CdZnSeTe, CdZnSTe, CdHgSeS, CdHgSeTe, CdHgSTe, HgZnSeS, HgZnSeTe, or HgZnSTe, but are not limited thereto.

The Group III-V compound semiconductor nanocrystals can be, in an exemplary embodiment, semiconductor nanocrystals of a binary compound, such as GaN, GaP, GaAs, GaSb, InP, InAs or InSb; semiconductor nanocrystals of a ternary compound, such as GaNP, GaNAs, GaNSb, GaPAs, GaPSb, InNP, InNAs, InNSb, InPAs, InPSb, or GaAlNP; or semiconductor nanocrystals of a quaternary compound, such as GaAlNAs, GaAlNSb, GaAlPAs, GaAlPSb, GaInNP, GaInNAs, GaInNSb, GaInPAs, GaInPSb, InAlNP, InAlNAs, InAlNSb, InAlPAs, or InAlPSb, but are not limited thereto.

The Group IV-VI compound semiconductor nanocrystals can be, in an exemplary embodiment, semiconductor nanocrystals of a binary compound, such as PbS, PbSe, or PbTe; semiconductor nanocrystals of a ternary compound, such as PbSeS, PbSeTe, PbSTe, SnPbS, SnPbSe, or SnPbTe; or semiconductor nanocrystals of a quaternary compound, such as SnPbSSe, SnPbSeTe, or SnPbSTe, but are not limited thereto. The Group IV compound semiconductor nanocrystals can be, in an exemplary embodiment, semiconductor nanocrystals of a unary compound, such as Si or Ge; or semiconductor nanocrystals of a binary compound, such as SiC or SiGe, but are not limited thereto.

The semiconductor nanocrystals can be a material having a core/shell structure in which the shell comprises a wide band gap semiconductor material selected from among combinations of the foregoing semiconductor nanocrystal materials, including core/shell structures such as for example CdSe/ZnS, CdSe/ZnSe, CdTe/ZnS, CdTe/ZnSe, CdSe/CdS, CdS/ZnS, CdS/ZnSe, InP/ZnS, and PbSe/ZnS.

In an embodiment, the semiconductor nanocrystal layer has a monolayer structure in which the semiconductor nanocrystals are arranged in a single layer. Alternatively, in another embodiment, the semiconductor nanocrystal layer can have a multilayer structure consisting of a plurality of monolayers.

Semiconductor nanocrystals having the same color can be used to form a monolayer. A mixture of semiconductor nanocrystals having different colors may be used to form a monolayer such that a mixed color, such as for example white, can be created. Also, semiconductors having the same color can be stacked to form a multilayer while creating a mixed color, such as for example white.

In an embodiment, the thickness of the light-emitting layer is from 3 nm to 100 nm, but is not limited to this range.

Inorganic materials for the inorganic electron transport layer of the inorganic electroluminescent device are not limited so long as they are capable of transporting electrons. Exemplary inorganic materials for the inorganic electron transport layer include metal oxides, such as $TiO_2$, ZnO, $SiO_2$, $SnO_2$, $WO_3$, $ZrO_2$, $HfO_2$, $Ta_2O_5$, $BaTiO_3$, $BaZrO_3$, $Al_2O_3$, $Y_2O_3$, and $ZrSiO_4$; and semiconductors having a band gap 2.4 eV or higher, such as CdS, ZnSe, and ZnS. In an embodiment, the thickness of the inorganic electron transport layer is from 10 nm to 100 nm, but is not limited to this range.

Materials for the electron injecting electrode of the inorganic electroluminescent device can include In, Ca, Ba, Ca/Al, Al, Mg, and Ag/Mg alloys, but are not limited thereto. In an embodiment, the thickness of the electron injecting electrode is from 50 nm to 300 nm, but is not limited to this range.

The inorganic electroluminescent device can further comprise a second hole transport layer formed between the hole transport layer and the hole injecting electrode or between the hole transport layer and the light-emitting layer.

Exemplary materials for the second hole transport layer include poly(3,4-ethylenedioxythiophene (PEDOT)/polystyrene parasulfonate (PSS), poly-N-vinylcarbazole, polyphenylenevinylene, polyparaphenylene, polymethacrylate, poly(9,9-octylfluorene), poly(spiro-fluorene), N,N'-diphenyl-N,N'-bis(3-methylphenyl)-1,1'-biphenyl-4,4'-diamine (TPD), N,N'-di(naphthalen-1-yl)-N-N'-diphenyl-benzidine, tris(3-methylphenylphenylamino)-triphenylamine (m-MTDATA), poly(9,9'-dioctylfluorene-co-N-(4-butylphenyl)diphenylamine) (TFB), copper phthalocyanine, polyvinylcarbazole (PVK), and derivatives thereof; starburst materials; metal oxides, such as $TiO_2$, ZnO, $SiO_2$, $SnO_2$, $WO_3$, $ZrO_2$, $HfO_2$, $Ta_2O_5$, $BaTiO_3$, $BaZrO_3$, $Al_2O_3$, $Y_2O_3$, and $ZrSiO_4$; and semiconductors having a band gap of 2.4 eV or higher, such as CdS, ZnSe, and ZnS, but are not limited thereto.

The inorganic electroluminescent device can further comprise one or more layers selected from the group consisting of an electron blocking layer, a hole blocking layer and an electron/hole blocking layer formed between the hole transport layer and the hole injecting electrode or between the inorganic electron transport layer and the light-emitting layer.

Exemplary materials suitable for the additional layers include, but are not limited to, 3-phenyl-4-(1-naphthyl)-5-phenyl-1,2,4-triazole (TAZ), 2,9-dimethyl-4,7-diphenyl-1,10-phenanthroline (BCP), phenanthrolines, imidazoles, triazoles, oxadiazoles, and aluminum complexes. In an embodiment, the thickness of the layers is from 5 nm to 50 nm, but is not limited to this range.

FIG. 1 is a schematic cross-sectional view of an inorganic electroluminescent device according to one embodiment.

Referring to FIG. 1, the inorganic electroluminescent device has a structure in which a substrate 10, a hole injecting electrode 20 disposed on a surface of substrate 10, a hole transport layer 30 disposed on a surface of hole injecting electrode 20 opposite substrate 10, a light-emitting layer 40 disposed on a surface of hole transport layer 30 opposite hole injecting electrode 20, an inorganic electron transport layer 50 disposed on a surface of light-emitting layer 40 opposite hole transport layer 30, an insulating layer 60 disposed on a surface of inorganic electron transport layer 50 opposite light-emitting layer 40, and an electron injecting electrode 70 disposed on a surface of insulating layer 60 opposite inorganic electron transport layer 50, wherein the respective layers are stacked in this order from the bottom (i.e., substrate-side) of the device, but is not limited to this structure.

When a voltage is applied to the hole injecting electrode 20 and the electron injecting electrode 70, holes are injected from the hole injecting electrode 20 into the hole transport layer 30 and electrons are injected from the electron injecting electrode 70 into the inorganic electron transport layer 50. The injected holes and electrons combine together at the same molecules to form excitons, after which the excitons recombine to emit light.

Figure 2:
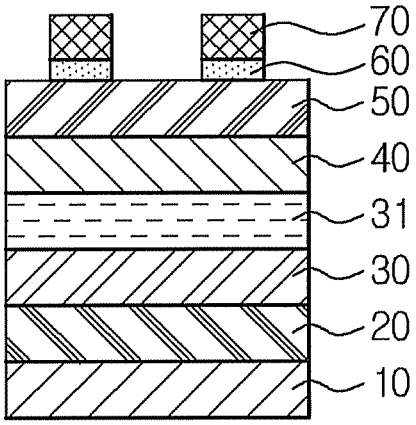
FIG. 2 is a schematic cross-sectional view of an exemplary inorganic electroluminescent device according to another embodiment.

FIG. 2 is a schematic cross-sectional view of an inorganic electroluminescent device according to another embodiment.

Referring to FIG. 2, the inorganic electroluminescent device has a structure in which a substrate 10, a hole injecting electrode 20 disposed on a surface of substrate 10, a first hole transport layer 30 disposed on a surface of hole injecting electrode 20 opposite substrate 10, a second hole transport layer 31 disposed on a surface of first hole transport layer 30 opposite hole injecting electrode 20, a light-emitting layer 40 disposed on a surface of second hole transport layer 31 opposite first hole transport layer 30, an inorganic electron transport layer 50 disposed on a surface of light-emitting layer 40 opposite second hole transport layer 31, an insulating layer 60 disposed on a surface of electron transport layer 50 opposite light-emitting layer 40, and an electron injecting electrode 70 disposed on a surface of insulating layer 60 opposite electron transport layer 50, and stacked in this order from the bottom (i.e., substrate-side) of the device, but is not limited to this structure.

The second hole transport layer 31 allows its highest-occupied molecular orbital ("HOMO") energy level to build up stepwise to the energy level between the HOMO energy level of the first hole transport layer 30 and the valence band of the semiconductor nanocrystal-containing light-emitting layer 40, thereby facilitating the efficient injection of holes. Alternatively, since the lowest-unoccupied molecular orbital ("LUMO") energy level of the second hole transport layer 31 is higher than the conduction band of the semiconductor nanocrystal-containing light-emitting layer 40, the second hole transport layer 31 plays a role in blocking excess electrons entering through the semiconductor nanocrystal-containing light-emitting layer 40 from the cathode (i.e., the electron injecting layer 70) to reduce the amount of current flowing through the device because, resulting in an improvement in the overall efficiency of the device.

In another embodiment, a method for fabricating an inorganic electroluminescent device comprising a hole transport layer, a light-emitting layer, an inorganic electron transport layer and an electron injecting electrode sequentially formed (starting with the hole transport layer) on a hole injecting electrode (itself disposed on a surface of a substrate) wherein an insulating layer is formed between the electron injecting electrode and the inorganic electron transport layer, the method comprising the step of depositing an inorganic or organic insulating material on a surface of the inorganic electron transport layer prior to deposition of the electron injecting electrode to form the insulating layer between the electron injecting electrode and the inorganic electron transport layer.

Any insulating material may be used to form the insulating layer (see, for example, insulating layer 60 in FIGS. 1 and 2). As the inorganic insulating material, there can be used, without limitation, LiF, $BaF_2$, $TiO_2$, ZnO, $SiO_2$, SiC, $SnO_2$, $WO_3$, $ZrO_2$, $HfO_2$, $Ta_2O_5$, $BaTiO_3$, $BaZrO_3$, $Al_2O_3$, $Y_2O_3$, $ZrSiO_4$, $Si_3N_4$, or TiN.

In an embodiment, the organic insulating material can be without limitation, a polymer, such as an epoxy or phenolic resin; a phenyl substituted triazole such as 3-(4-biphenylyl)-4-phenyl-5-tert-butylphenyl-1,2,4-triazole ("TAZ"), 3,4,5-triphenyl-1,2,4-triazole, 3,5-bis(4-tert-butylphenyl)-4-phenyl-1,2,4-triazole; or a fatty acid monomer, such as arachidic acid or stearic acid.

In an embodiment, the insulating layer has a thickness of 0.5 nm to 2 nm. If the insulating layer is excessively thick (greater than 2 nm), the total thickness of the layers into which electrons are injected increases, preventing flow of current or causing a marked increase in resistance by inhibiting current flow. If the insulating layer is in the form of a thin film having a thickness as defined above, tunneling of electrons can occur, which allows a reduction in the total thickness of the layers into which electrons are injected from the cathode.

The method can further comprise introducing a second hole transport layer between the hole transport layer and the hole injecting electrode or between the hole transport layer and the light-emitting layer. The introduction of the second hole transport layer can be achieved by any known technique.

The method can further comprise introducing a hole injecting layer between the hole injecting electrode and the hole transport layer, introducing an electron blocking layer between the hole transport layer and the light-emitting layer, or introducing a hole blocking layer between the light-emitting layer and the inorganic electron transport layer. The introduction of the additional layer can be achieved by any known technique.

A more detailed description of the method is provided below. First, a material for a hole transport layer is coated on a surface of a hole injecting electrode, and annealed to form a hole transport layer in the form a hard thin film. The coating of the material can be accomplished by any of a variety of coating techniques. A dispersion of nanocrystals dispersed in a solvent, and which does not dissolve the hole transport layer, is coated on a surface of the hole transport layer opposite the hole injecting electrode, to form a nanocrystal light-emitting layer in the form of a thin film distinct from but adjacent to the hole transport layer. The coating of the dispersion can be accomplished by any of a variety of coating techniques. An inorganic electron transport layer and an insulating layer are sequentially formed on the nanocrystal light-emitting layer by disposing the inorganic electron transport layer on a surface of the nanocrystal light-emitting layer opposite the hole transport layer, and the insulating layer is formed in turn on a surface of the inorganic electron transport layer opposite the nanocrystal light-emitting layer. An electron injecting electrode, is formed on the insulating layer opposite the inorganic electron transport layer.

FIG. 1 is a schematic cross-sectional view of an exemplary inorganic electroluminescent device according to one embodiment. Referring to FIG. 1, an explanation of a method for fabricating inorganic electroluminescent device will be given below. First, a hole injecting electrode layer is formed on a surface of substrate 10, followed by patterning to provide the hole injecting electrode 20. A hole transport layer 30 is formed on the patterned hole injecting electrode by any coating technique, such as spin coating, and annealed such that it is hard enough to withstand any damage that may occur during subsequent formation of a nanocrystal light-emitting layer.

Thereafter, a dispersion of nanocrystals in a solvent that does not readily dissolve hole transport layer 30, is coated on a surface of hole transport layer 30 opposite hole injecting electrode 20 to form an independent light-emitting layer 40 in the form of a thin film. The coating of the dispersion can be performed by any coating technique, such as spin coating. An inorganic electron transport layer 50 is formed on a surface of the light-emitting layer 40 opposite hole transport layer 30, and then an insulating layer 60 is formed on a surface of electron transport layer 50 opposite the light-emitting layer 40 by a deposition process, wherein such deposition processes can include, for example: thermal evaporation; vapor deposition such as for example physical vapor deposition ("PVD"), chemical vapor deposition ("CVD"), or sputtering; or a wet process, such as spin coating, dip coating, roll coating, screen coating, spray coating, spin casting, flow coating, screen printing, ink jetting or drop casting. An electron injecting electrode 70 is deposited on a surface of the insulating layer 60 opposite electron transport layer 50 to complete the fabrication of the inorganic electroluminescent device according to an embodiment.

The patterned substrate (i.e., the substrate 10 having the hole injecting electrode 20 patterned thereon) is typically cleaned prior to deposition of subsequent layers with one or more solvents selected from neutral detergents, deionized water, acetone and isopropyl alcohol, and is then treated by exposure to UV-ozone and plasma.

According to the method of the present invention, the light-emitting layer 40 in the form of a thin film can be formed by dispersing nanocrystals coordinated to a material having a photosensitive group in a solvent that does not damage the hole transport layer (such as by dissolving or eroding the layer), and coating the dispersion on the hole transport layer. Alternatively, the light-emitting layer 40 present as a thin film may be formed by dispersing nanocrystals coordinated to a material having no photosensitive group, and a photosensitive material in a solvent that does not damage the hole transport layer, and coating the dispersion on a surface of the hole transport layer.

The solvent of the nanocrystal dispersion that does not damage the hole transport layer may be selected from the group consisting of water, pyridine, ethanol, propanol, butanol, pentanol, hexanol, toluene, chloroform, chlorobenzene, THF, cyclohexane, cyclohexene, methylene chloride, pentane, hexane, heptane, octane, nonane, decane, undecane, dodecane, and mixtures thereof.

The light-emitting layer 40 may be crosslinked by irradiation of the light-emitting layer 40 with UV light prior to the formation of the inorganic electron transport layer 50 on the light-emitting layer 40. The UV irradiation may be carried out by exposing the light-emitting layer 40 to UV light at a wavelength of from 200 nm to 450 nm to crosslink the light-emitting layer. Alternatively, after coating of nanocrystals for the light-emitting layer 40, a crosslinking agent can be used to form a monolayer or multilayered structure of quantum dots formed by crosslinking of the nanocrystals.

The inorganic electron transport layer 50 may be formed by vacuum evaporation or wet coating.

The hole transport layer 30 and the electron transport layer 50 may be formed into thin films by any coating technique, such as for example spin coating, dip coating, spray coating or blade coating. The exposure of the thin film can be performed by a contact or non-contact method. The inorganic electron transport layer 50 may be formed on the light-emitting layer 40 by, for example, thermal evaporation, molecular beam epitaxy, or chemical vapor deposition.

Subsequently, the insulating layer 60 is formed on a surface of the inorganic electron transport layer 50 by a process including thermal evaporation; vapor deposition, such as physical vapor deposition (PVD), chemical vapor deposition (CVD) or sputtering; or a wet process, such as spin coating, dip coating, roll coating, screen coating, spray coating, spin casting, flow coating, screen printing, ink jetting or drop casting. The electron injecting electrode 70 is formed using In, Ca, Ba, Ca/Al, Al, Mg, or Ag/Mg alloy on the insulating layer 60 by thermal evaporation or physical vapor deposition (PVD) to complete the fabrication of the inorganic electroluminescent device.

In an embodiment, after formation of the respective thin films, drying is carried out at a temperature of 20° C. to 300° C., and more specifically at 40° C. to 120° C. The photosensitization is carried out at an energy of about 50 mJ/cm$^2$ to about 850 mJ/cm$^2$. The photosensitization energy may vary depending on the intended thickness of the thin film. Out of the energy range, sufficient crosslinking may not be induced or damage to the thin film may occur. In an embodiment, the photosensitization is carried out using a light source having an effective wavelength of 200 nm to 500 nm, specifically 300 nm to 400 nm, and at an output energy for the light source of about 100 W to about 800 W.

In still another embodiment, an electronic device comprises the inorganic electroluminescent device.

The introduction of the thin insulating layer between the electron injecting electrode and the inorganic electron transport layer of the inorganic electroluminescent device unexpectedly eliminates occurrence of fringe field effects toward the edges of the electron injecting electrode so that electrons are efficiently injected and light is emitted from the entire light-emitting surface of the device. Therefore, the inorganic electroluminescent device is suitable for use in the manufacture of electronic devices, including display devices, illuminators, and backlight units.

Hereinafter, exemplary embodiments of the present invention will be described in detail with reference to the following examples. However, these examples are given for the purpose of illustration and are not intended to limit the present invention.

EXAMPLE

Example 1

Fabrication of Inorganic Electroluminescent Device (1)

ITO was deposited on a glass substrate and patterned to form an electrode structure (i.e., a patterned substrate). The patterned substrate was sequentially cleaned with a neutral detergent, deionized water, acetone, and/or isopropyl alcohol, and was treated with UV-ozone. A solution of 1 wt % of poly(3,4-ethylenedioxythiophene) (PEDOT) in chlorobenzene was spin-coated to a thickness of about 50 nm on the patterned surface of the substrate to form a hole transport layer, followed by annealing at 200° C. for 5 minutes.

Subsequently, a dispersion of CdSe/ZnS nanocrystals (1 wt %) in octane, used as a solvent that is not damaging to the hole transport layer, was spin-coated on the hole transport layer and completely dried to form a nanocrystal light-emitting layer having a thickness of about 5 nm.

A $TiO_2$ precursor sol (DuPont Tyzor®, BTP, 2.5 wt % in butanol) was spin-coated at 2,000 rpm on the nanocrystal light-emitting layer for 30 seconds, dried for about 5 minutes, and annealed at 100° C. for 15 minutes to form an amorphous $TiO_2$ thin film as an electron transport layer having a thickness of about 40 nm.

LiF was deposited to a thickness of 1 nm on the electron transport layer by thermal evaporation to form an insulating layer, and aluminum was deposited to a thickness of 200 nm on the insulating layer by thermal evaporation to form an electrode, completing the fabrication of an inorganic electroluminescent device.

Example 2

Fabrication of Inorganic Electroluminescent Device (2)

ITO was deposited on a glass substrate and patterned as in Example 1. The patterned substrate was sequentially cleaned with a neutral detergent, deionized water, acetone, and/or isopropyl alcohol, and was treated with UV-ozone. A solution of 1 wt % of poly(3,4-ethylenedioxythiophene) (PEDOT) in chlorobenzene was spin-coated to a thickness of about 50 nm on the patterned surface of the substrate to form a hole transport layer, followed by annealing at 180° C. for 10 minutes.

Then, a solution of 0.1 g of polyvinylcarbazole ("PVK") in chlorobenzene (0.1 g/14 ml) was spin-coated to a thickness of about 20 nm on the hole transport layer to form a second hole transport layer, and dried at 60° C. for 10 minutes.

Subsequently, a dispersion of CdSe/ZnS nanocrystals (0.3 wt %) in cyclohexane, used as a solvent that is not damaging to the second hole transport layer, was spin-coated on the second hole transport layer and completely dried in air to form a nanocrystal light-emitting layer having a thickness of about 25 nm.

$TiO_2$ was deposited to a thickness of about 40 nm on the nanocrystal light-emitting layer, using the same process described in Example 1, to form an electron transport layer. LiF was deposited to a thickness of 0.5 nm on the electron transport layer by thermal evaporation to form an insulating layer, and aluminum was deposited to a thickness of 200 nm on the insulating layer by thermal evaporation to form an electrode, completing the fabrication of an inorganic electroluminescent device.

Example 3

Fabrication of Inorganic Electroluminescent Device (3)

ITO was deposited on a glass substrate and patterned to form an electrode structure. The patterned substrate was sequentially cleaned with neutral detergent, deionized water, acetone, and/or isopropyl alcohol, and treated with UV-ozone. A solution of 1 wt % of poly(3,4-ethylenedioxythiophene) (PEDOT) in chlorobenzene was spin-coated to a thickness of about 50 nm on the patterned surface of the substrate to form a hole transport layer, followed by annealing at 200° C. for 10 minutes.

Subsequently, a dispersion of CdSe/ZnS nanocrystals (1 wt %) in octane, used as a solvent that is not damaging to the hole transport layer, was spin-coated on the hole transport layer and completely dried to form a nanocrystal light-emitting layer having a thickness of about 5 nm.

3-(4-Biphenylyl)-4-phenyl-5-(4-tert-butylphenyl)-1,2,4-triazole (TAZ) was deposited to a thickness of about 10 nm on the nanocrystal light-emitting layer to form a hole blocking layer, and then $TiO_2$ was deposited to a thickness of about 40 nm on the hole blocking layer by E-beam evaporation to form an electron transport layer. LiF was deposited to a thickness of 1 nm on the electron transport layer by thermal evaporation to form an insulating layer, and aluminum was deposited to a thickness of 200 nm on the insulating layer by thermal evaporation to form an electrode, completing the fabrication of an inorganic electroluminescent device.

Example 4

Fabrication of Inorganic Electroluminescent Device (4)

An inorganic electroluminescent device was fabricated in the same manner as in Example 2, except that $SiO_2$ was used to form the insulating layer at a thickness of 0.5 nm.

Example 5

Fabrication of Inorganic Electroluminescent Device (5)

An inorganic electroluminescent device was fabricated in the same manner as in Example 2, except that 3-(4-biphenylyl)-4-phenyl-5-tert-butylphenyl-1,2,4-triazole (TAZ) was used to form the insulating layer at a thickness of 1 nm.

Comparative Example 1

Fabrication of Prior Art Inorganic Electroluminescent Device (1)

An inorganic electroluminescent device was fabricated in the same manner as in Example 1, except that an LiF insulating layer was not included in the structure.

Comparative Example 2

Fabrication of a Prior Art Inorganic Electroluminescent Device (2)

An inorganic electroluminescent device was fabricated in the same manner as described in Comparative Example 1, except that $TiO_2$ was deposited to a thickness of 40 nm by E-beam evaporation to form an electron transport layer in the form of a thin film.

Test Example 1

Comparison of Luminescence Efficiency Between Inorganic Electroluminescent Devices (1)

To determine the luminescence efficiency of the inorganic electroluminescent device, which comprises an electron injecting electrode, an inorganic electron transport layer and an insulating layer formed therebetween, the brightness (luminance) per unit current of the inorganic electroluminescent devices fabricated in Example 2 and Comparative Example 1 was measured using a I-V-L tester at ambient pressure and temperature conditions with increasing voltage applied to the devices to compare the luminescence efficiency of the devices. The results are shown in FIGS. 3*a* and 3*b*.

Figure 3A:
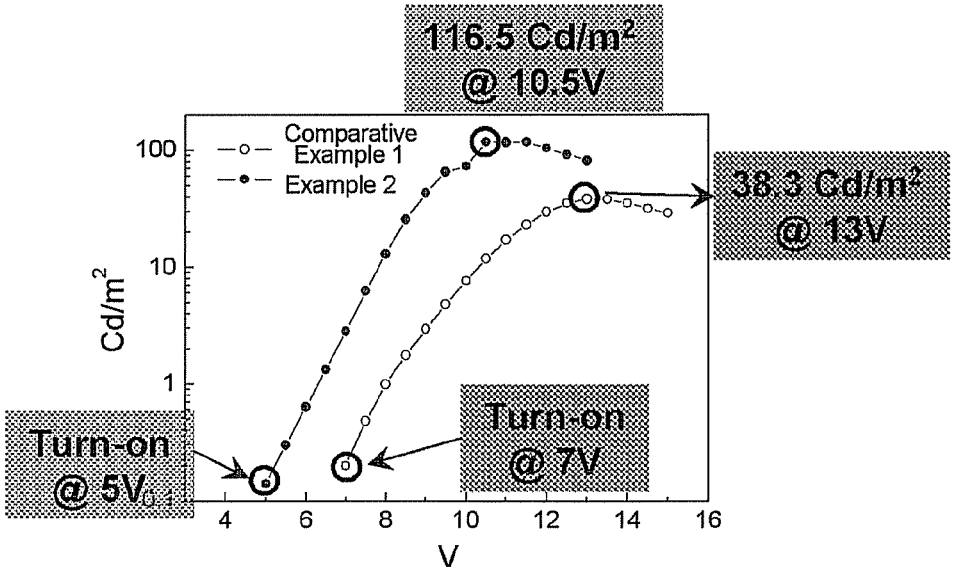
FIGS. 3*a* and 3*b* are logarithmic scale and linear scale graphs showing the current-voltage-luminance ("IVL") characteristics of exemplary inorganic electroluminescent devices fabricated in Example 2 and Comparative Example 1, respectively.
Figure 3B:
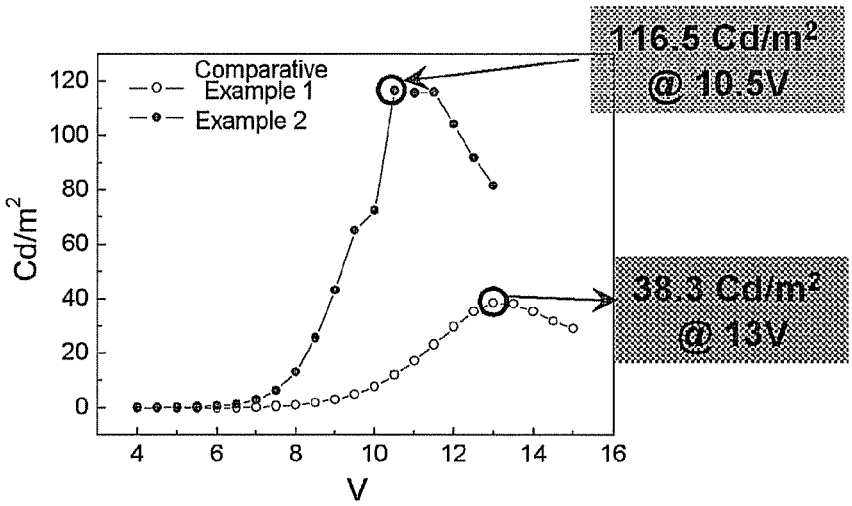

FIGS. 3*a* and 3*b* are logarithmic scale and linear scale graphs showing the current-voltage-luminance (IVL) characteristics of the inorganic electroluminescent devices fabricated in Example 2 and Comparative Example 1, respectively.

From the graphs of FIGS. 3*a* and 3*b*, it can be seen that due to the presence of the LiF thin film as an insulating layer, the turn-on voltage (5 V) of the inorganic electroluminescent device fabricated in Example 2 was lower than that (7 V) of the inorganic electroluminescent device fabricated in Comparative Example 1 and the maximum luminance value (116.5 $Cd/m^2$) of the inorganic electroluminescent device fabricated in Example 2 was more than three time higher than that (38.3 $Cd/m^2$) of the inorganic electroluminescent device fabricated in Comparative Example 1. These results indicate that the electroluminescent device of Example 2 showed reduced edge emission and relatively uniform light emission from the entire light-emitting surface of the device.

Test Example 2

Comparison of Luminescence Efficiency Between Inorganic Electroluminescent Devices (2)

Figure 4:
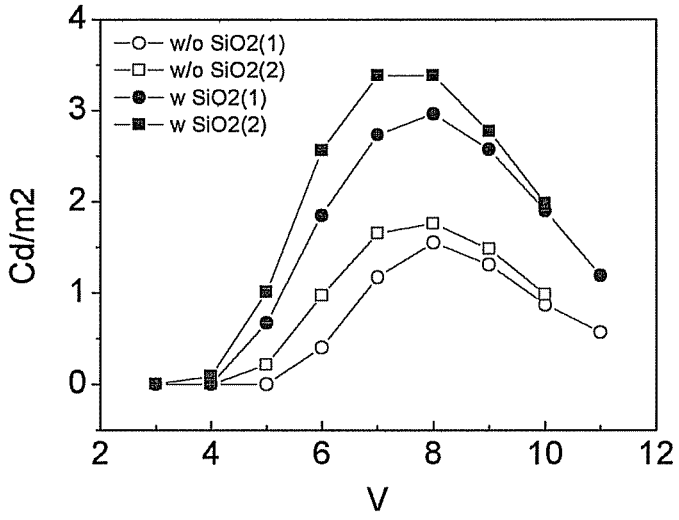
FIG. 4 is a graph showing the luminescence efficiency of exemplary inorganic electroluminescent devices fabricated in Example 4 and Comparative Example 2.

To determine the luminescence efficiency of the inorganic electroluminescent device, which comprise an electron injecting electrode, an inorganic electron transport layer and an insulating layer formed therebetween, the brightness (luminance) per unit current of the inorganic electroluminescent devices fabricated in Example 4 and Comparative Example 1 was measured using a I-V-L tester with increasing voltage applied to the devices at ambient pressure and temperature conditions to compare the luminescence efficiency of the inorganic electroluminescent devices. The results are shown in FIG. 4. Two samples of each of the devices were fabricated and tested for luminescence efficiency to ascertain the reproducibility of the devices.

The results of FIG. 4 demonstrates that the maximum luminance (1.5 $Cd/m^2$ at about 8V) of the device fabricated in Comparative Example 1, which comprises no $SiO_2$ insulating layer, was about half that (about 3 $Cd/m^2$ at about 8V) of the device fabricated in Example 4, which comprises a 0.5 nmthick $SiO_2$ insulating layer. In addition, the results indicate that the electroluminescent device of the Example 4 showed reduced edge emission and relatively uniform light emission from the entire light-emitting surface of the device.

As apparent from the above description, the inorganic electroluminescent device comprises an electron injecting electrode, an inorganic electron transport layer and a thin insulating layer formed therebetween. This structure of the inorganic electroluminescent device eliminates occurrence of strong fringe field effects at the edges of the electron injecting electrode and achieves uniform light emission from the entire light-emitting surface of the device, leading to an improvement in the reliability and stability of the device. Therefore, the inorganic electroluminescent devices as disclosed herein are suitable for use in the manufacture of electronic devices, including display devices, illuminators and backlight units.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An inorganic electroluminescent device comprising a hole transport layer, a light-emitting layer, an inorganic electron transport layer and an electron injecting electrode sequentially formed on a hole injecting electrode wherein an insulating layer is formed between the electron injecting electrode and the inorganic electron transport layer, further comprising one or more layers selected from the group consisting of an electron blocking layer and an electron/hole blocking layer formed between the hole transport layer and the hole injecting electrode or between the inorganic electron transport layer and the light-emitting layer, wherein the insulating layer is formed from an organic insulating material.

2. The inorganic electroluminescent device according to claim 1, wherein the inorganic electroluminescent device comprises a substrate, a hole injecting electrode formed on a surface of the substrate, a hole transport layer formed on a surface of the hole injecting electrode opposite the substrate, a light-emitting layer formed on a surface of the hole transport layer opposite the hole injecting electrode, an inorganic electron transport layer formed on a surface of the light-emitting layer opposite the hole transport layer, an insulating layer formed on a surface of the inorganic electron transport layer opposite the light-emitting layer, and an electron injecting electrode formed on a surface of the insulating layer opposite the inorganic electron transport layer, wherein the layers are stacked in this order from the substrate.

3. The inorganic electroluminescent device according to claim 1, wherein the organic insulating material is selected from the group consisting of polymers, phenyl-substituted triazoles, and fatty acid monomers.

4. The inorganic electroluminescent device according to claim 3, wherein the polymers include epoxy resins or phenolic resins; the phenyl-substituted triazoles include 3-(4-biphenylyl)-4-phenyl-5-tert-butylphenyl-1,2,4-triazole, 3,4,5-triphenyl-1,2,4-triazole, or 3,5-bis(4-tert-butylphenyl)-4-phenyl-1,2,4-triazole; and the fatty acid monomers include arachidic acid or stearic acid.

5. The inorganic electroluminescent device according to claim 1, wherein the insulating layer has a thickness of 0.5 nm to 2 nm.

6. The inorganic electroluminescent device according to claim 1, wherein the hole injecting electrode is made of a material selected from the group consisting of indium tin oxide, indium zinc oxide, nickel, platinum, gold, silver, iridium, and oxides of these metal elements.

7. The inorganic electroluminescent device according to claim 1, wherein the hole transport layer is formed of a material selected from the group consisting of poly(3,4-ethylenedioxythiophene (PEDOT)/polystyrene parasulfonate (PSS), poly-N-vinylcarbazole, polyphenylenevinylene, polyparaphenylene, polymethacrylate, poly(9,9-octylfluorene), poly(spiro-fluorene), N,N'-diphenyl-N,N'-bis(3-methylphenyl)-1,1'-biphenyl-4,4'-diamine (TPD), N,N'-di(naphthalen-1-yl)-N—N'-diphenyl-benzidine, tris(3-methylphenylphenylamino)-triphenylamine (m-MTDATA), poly(9,9'-dioctylfluorene-co-N-(4-butylphenyl)diphenylamine) (TFB), copper phthalocyanine, polyvinylcarbazole (PVK); derivatives of the foregoing; starburst dendrimers; metal oxides; and semiconductors having a band gap of 2.4 eV or higher.

8. The inorganic electroluminescent device of claim 7, wherein the metal oxides include $TiO_2$, ZnO, $SiO_2$, $SnO_2$, $WO_3$, $ZrO_2$, $HfO_2$, $Ta_2O_5$, $BaTiO_3$, $BaZrO_3$, $Al_2O_3$, $Y_2O_3$, or $ZrSiO_4$, and the semiconductors having a band gap of 2.4 eV or higher include Cds, ZnSe, or ZnS.

9. The inorganic electroluminescent device according to claim 1, wherein the light-emitting layer is formed of a material selected from the group consisting of Group II-VI compound semiconductor nanocrystals, Group III-V compound semiconductor nanocrystals, Group IV-VI compound semiconductor nanocrystals, Group IV compound semiconductor nanocrystals, and mixtures thereof.

10. The inorganic electroluminescent device according to claim 9, wherein the Group II-VI compound semiconductor nanocrystals are selected from the group consisting of semiconductor nanocrystals of binary compounds, semiconductor nanocrystals of ternary compounds, and semiconductor nanocrystals of quaternary compounds; the Group III-V compound semiconductor nanocrystals are selected from the group consisting of semiconductor nanocrystals of binary compounds, semiconductor nanocrystals of ternary compounds, and semiconductor nanocrystals of quaternary compounds; the Group IV-VI compound semiconductor nanocrystals are selected from the group consisting of semiconductor nanocrystals of binary compounds, semiconductor nanocrystals of ternary compounds, and semiconductor nanocrystals of quaternary compounds; the Group IV compound semiconductor nanocrystals are selected from the group consisting of semiconductor nanocrystals of unary compounds, and semiconductor nanocrystals of binary compounds; semiconductor nanocrystals having a core/shell structure in which the shell comprises a wide band gap semiconductor material, and mixtures thereof.

11. The inorganic electroluminescent device according to claim 9, wherein the Group II-VI binary compounds include CdSe, CdTe, ZnS, ZnSe, or ZnTe; the Group II-VI ternary compounds include CdSeS, CdSeTe, CdSTe, ZnSeS, ZnSeTe, ZnSTe, CdZnS, CdZnSe, or CdZnTe; the Group II-VI quaternary compounds include CdZnSeS, CdZnSeTe, CdZnSTe, CdHgSeS, CdHgSeTe, CdHgSTe, HgZnSeS, HgZnSeTe, or HgZnSTe; the Group III-V binary compounds include GaN, GaP, GaAs, GaSb, InP, InAs, or InSb; the Group III-V ternary compounds include GaNP, GaNAs, GaNSb, GaPAs, GaPSb, InNP, InNAs, InNSb, InPAs, InPSb, or GaAlNP; the Group III-V quaternary compounds include GaAlNAs, GaAlNSb, GaAlPAs, GaAlPSb, GaInNP, GaInNAs, GaInNSb, GaInPAs, GaInPSb, InAlNP, InAlNAs, InAlNSb, InAlPAs, or InAlPSb; the Group IV-VI binary compounds include PbS, PbSe, or PbTe; the Group IV-VI ternary compounds include PbSeS, PbSeTe, PbSTe, SnPbS, SnPbSe, or SnPbTe; the Group IV-VI quaternary compounds include SnPbSSe, SnPbSeTe, or SnPbSTe; the Group IV unary compounds include Si or Ge; the Group IV binary compounds include SiC or SiGe; and wherein the nanocrystals having a core/shell structure include CdSe/ZnS, CdSe/ZnSe, CdTe/ZnS, CdTe/ZnSe, CdSe/CdS, CdS/ZnS, CdS/ZnSe, InP/ZnS, or PbSe/ZnS.

12. The inorganic electroluminescent device according to claim 1, wherein the inorganic electron transport layer is formed of a material selected from the group consisting of metal oxides, and semiconductors having a band gap 2.4 eV or higher.

13. The inorganic electroluminescent device according to claim 12, wherein the metal oxides include $TiO_2$, ZnO, $SiO_2$, $SnO_2$, $WO_3$, $ZrO_2$, $HfO_2$, $Ta_2O_5$, $BaTiO_3$, $BaZrO_3$, $Al_2O_3$, $Y_2O_3$, or $ZrSiO_4$; and the semiconductors having a band gap 2.4 eV or higher include CdS, ZnSe, or ZnS.

14. The inorganic electroluminescent device according to claim 1, wherein the electron injecting electrode is formed a material selected from the group consisting of In, Ca, Ba, Ca/Al, Al, Mg, and Ag/Mg alloys.

15. The inorganic electroluminescent device according to claim 1, further comprising a second hole transport layer formed between the hole transport layer and the hole injecting electrode, or between the hole transport layer and the light-emitting layer.

16. The inorganic electroluminescent device according to claim 15, wherein the second hole transport layer is formed a material selected from the group consisting of poly(3,4-ethylenedioxythiophene (PEDOT)/polystyrene parasulfonate (PSS), poly-N-vinylcarbazole, polyphenylenevinylene, polyparaphenylene, polymethacrylate, poly(9,9-octylfluorene), poly(spiro-fluorene), N,N'-diphenyl-N,N'-bis(3-methylphenyl)-1,1'-biphenyl-4,4'-diamine (TPD), N,N'-di(naphthalen-1-yl)-N—N'-diphenyl-benzidine, tris(3-methylphenylphenylamino)-triphenylamine (m-MTDATA), poly(9,9'-dioctylfluorene-co-N-(4-butylphenyl)diphenylamine) (TFB), copper phthalocyanine, polyvinylcarbazole (PVK), derivatives of the foregoing; starburst dendrimers; metal oxides; and semiconductors having a band gap of 2.4 eV or higher.

17. The inorganic electroluminescent device according to claim 16, wherein the metal oxides include $TiO_2$, ZnO, $SiO_2$, $SnO_2$, $WO_3$, $ZrO_2$, $HfO_2$, $Ta_2O_5$, $BaTiO_3$, $BaZrO_3$, $Al_2O_3$, $Y_2O_3$, or $ZrSiO_4$, and the semiconductors having a band gap of 2.4 eV or higher include Cds, ZnSe, or ZnS.

18. The inorganic electroluminescent device according to claim 1, wherein the electron blocking layer, the hole blocking layer or the electron/hole blocking layer is formed of a material selected from the group consisting of 3-phenyl-4-(1-naphthyl)-5-phenyl-1,2,4-triazole (TAZ), 2,9-dimethyl-4,7-diphenyl-1,10-phenanthroline (BCP), phenanthrolines, imidazoles, triazoles, oxadiazoles, and aluminum complexes.

19. A method for fabricating an inorganic electroluminescent device comprising a hole transport layer, a light-emitting layer, an inorganic electron transport layer and an electron injecting electrode sequentially formed on a hole injecting electrode wherein an insulating layer is formed between the electron injecting electrode and the inorganic electron transport layer, the method comprising depositing an inorganic or organic insulating material on a surface of the inorganic electron transport layer to form the insulating layer disposed between the electron injecting electrode and the inorganic electron transport layer, wherein the insulating layer is formed from an organic insulating material; and introducing one or more layers selected from the group consisting of an electron blocking layer and an electron/hole blocking layer formed between the hole transport layer and the hole injecting electrode or between the inorganic electron transport layer and the light-emitting layer.

20. The method according to claim 19, wherein the insulating layer is formed by a process selected from the group consisting of thermal evaporation processes; vapor deposition processes; and wet processes.

21. The method according to claim 20, wherein the vapor deposition processes include physical vapor deposition (PVD), chemical vapor deposition (CVD), or sputtering; and the wet processes include spin coating, dip coating, roll coating, screen coating, spray coating, spin casting, flow coating, screen printing, ink jetting, or drop casting.

22. The method according to claim 19, wherein the organic insulating material is selected from the group consisting of polymers, phenyl-substituted triazoles, and fatty acid monomers.

23. The method according to claim 22, wherein the polymers include epoxy resins or phenolic resins; the phenyl-substituted triazoles include 3-(4-biphenylyl)-4-phenyl-5-tert-butylphenyl-1,2,4-triazole, 3,4,5-triphenyl-1,2,4-triazole, or 3,5-bis(4-tert-butylphenyl)-4-phenyl-1,2,4-triazole; and the fatty acid monomers include arachidic acid or stearic acid.

24. The method according to claim 19, wherein the insulating layer has a thickness of 0.5 nm to 2 nm.

25. The method according to claim 19, further comprising introducing a second hole transport layer between the hole transport layer and the hole injecting electrode or between the hole transport layer and the light-emitting layer.

26. The method according to claim 19, further comprising introducing a hole injecting layer between the hole injecting electrode and the hole transport layer, introducing an electron blocking layer between the hole transport layer and the light-emitting layer, and/or introducing a hole blocking layer between the light-emitting layer and the inorganic electron transport layer.

27. An electronic device comprising the inorganic electroluminescent device according to claim 1.

28. The electronic device according to claim 27, wherein the electronic device is a display device, an illuminator, or a backlight unit.

* * * * *